United States Patent [19]

Garrett

[11] Patent Number: 4,949,485

[45] Date of Patent: Aug. 21, 1990

[54] CONTINUOUSLY FLOWING DISPLAY DEVICE HAVING A PLURALITY OF VISUAL EFFECTS

[76] Inventor: Samuel G. Garrett, 2141 Bluebell Ave., Greeley, Colo. 80631

[21] Appl. No.: 279,066

[22] Filed: Dec. 2, 1988

[51] Int. Cl.[5] ..... G09F 19/00

[52] U.S. Cl. ..... 40/406; 40/407; 40/427; 239/20; 272/8 D

[58] Field of Search ..... 40/406, 407, 439, 427; 272/8 D; 239/20, 23

[56] References Cited

U.S. PATENT DOCUMENTS

| | | | |
|---|---|---|---|
| 1,064,873 | 6/1913 | Thowless | 272/8 D |
| 1,691,333 | 11/1928 | Boe | 40/407 |
| 2,029,183 | 1/1936 | Mukasa | 40/406 |
| 3,174,688 | 3/1965 | Chatten | 239/20 |
| 3,629,958 | 12/1971 | Olson et al. | 40/406 |
| 3,814,317 | 6/1974 | Hruby, Jr. | 239/20 |
| 4,149,674 | 4/1979 | Fukamizu et al. | 239/20 |
| 4,294,406 | 10/1981 | Pevnick | 239/20 |

FOREIGN PATENT DOCUMENTS

| | | | |
|---|---|---|---|
| 1004627 | 4/1952 | France | 40/406 |
| 256733 | 8/1948 | Switzerland | 40/406 |
| 228560 | 5/1925 | United Kingdom | 40/406 |
| 249829 | 9/1926 | United Kingdom | 40/406 |

*Primary Examiner*—James R. Brittain
*Assistant Examiner*—J. Hakamaki
*Attorney, Agent, or Firm*—Terry M. Gernstein

[57] ABSTRACT

A display device for creating an illusion of a continuous flow of fluid to a receptacle having a limited fluid containing capacity is adapted to produce a wide variety of, and multiplicity of, different visual effects. The device includes a manifold mounted on a return line from the receptacle to a pump, and fluid from the pump is delivered to the manifold which includes a drain for directed the fluid down the outside of the return line. The device includes a plurality of receptacles and can include various valves and controls so that the receptacles can be operated in a pre-determined sequence.

15 Claims, 4 Drawing Sheets

CONTINUOUSLY FLOWING DISPLAY DEVICE HAVING A PLURALITY OF VISUAL EFFECTS

TECHNICAL FIELD OF THE INVENTION

The present invention relates to the general field of animated display devices, and to the particular field of animated display devices for producing a fluid flow illusion. Specifically, the invention relates to such display devices as produce a fluid flow illusion of a continuously flowing fluid.

BACKGROUND OF THE INVENTION

Fluid flow illusions of the type depicting a continuous flow of fluid are often used for display or novelty purposes, and generally include a container and a receptacle combination which are fluidcally coupled together so as to produce an illusion that fluid is continuously flowing between the container and the receptacle.

As displays, these illusions are often used to advertise beverages, or the like, and as novelty items, these illusions are often used on bars, or the like, as conversation pieces.

Heretofore known fluid flow illusion devices of this type have been associated with a single container/-receptacle combination, and are thus limited in applications. For example, with only a single container/receptacle combination, visual effects are limited to a single fluid at any one time. Thus, multi-colored visual effects, "dancing waters" or other artistic and creative visual effects are either completely precluded or are severely restricted.

Accordingly, there is need for a fluid flow illusion device of the continuous flow type which is adaptable to producing a wide variety of and multiplicity of visual effects.

OBJECTS OF THE INVENTION

It is a main object of the invention to provide a continuous fluid flow illusion device which is adaptable to produce a plurality of, and wide variety of, different visual effects.

It is another object of the invention to provide a continuous fluid flow illusion device which is adaptable to produce a plurality of, and wide variety of, different visual effects including the operation of a plurality of receptacles.

It is another object of the invention to provide a continuous fluid flow illusion device which is adaptable to produce a plurality of, and wide variety of, different visual effects including the operation of a plurality of receptacles in a pre-selected sequence.

It is another object of the invention to provide a continuous fluid flow illusion device which is adaptable to produce a plurality of, and wide variety of, different visual effects including the use of plurality of different fluids.

SUMMARY OF THE INVENTION

These, and other, objects are accomplished by fluidically connecting a plurality of receptacles to a pump via one or more weirs which are associated with fluid return lines associated with the receptacles.

In the simplest aspect of the invention, each of a plurality of receptacles has a weir associated with a fluid return line fluidically connecting that receptacle with a pump. The weir provides fluid connection between the pump outlet and the outside of the fluid return line, and the fluid return line is connected to the pump inlet so that fluid returns from the receptacle to the pump and is directed down the outside of the fluid return line by the weir.

In this manner, a single pump can operate a plurality of receptacles to provide an ability to produce a plurality of different visual effects.

Other embodiments of the invention include means for operating each of the plurality of receptacles "independently" of the others to provide a sequential operation.

DETAILED DESCRIPTION OF THE PREFERRED EMBODIMENT

Figure 1:
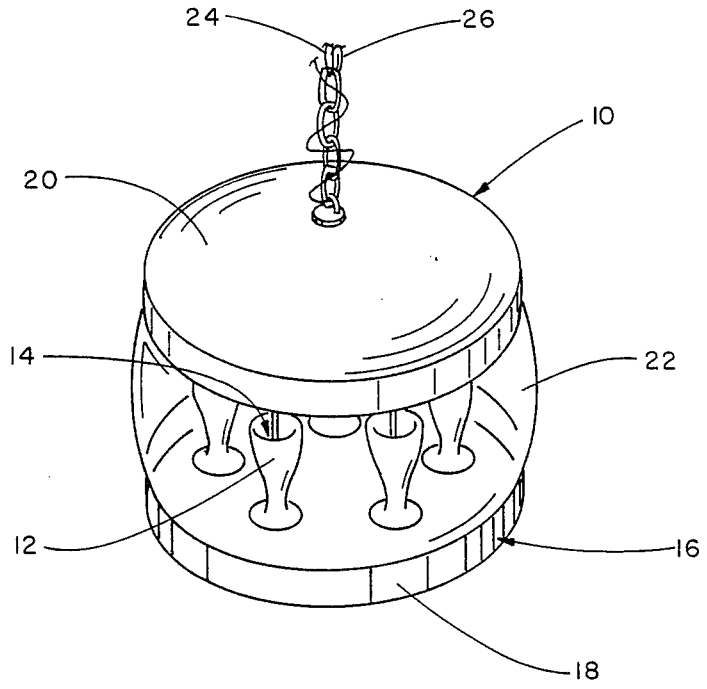
FIG. 1 is a perspective view of the device embodying the present invention.

Shown in FIG. 1 is a device 10 which is pendentally supported from an overhead support in the manner of a chandelier or the like to produce an illusion that fluid, such as water, is continuously flowing into a plurality of decorative receptacles, such as receptacle 12, from above, as is indicated in FIG. 1 by reference arrow 14. The device 10 includes a support 16 having a base 18 connected to a top 20 by a centrally located fastener (not shown) or by a transparent wall 22 formed of clear plastic, glass or the like. The support 16 can be supported from a ceiling by a chain 24 or the like, and a power cord 26 can be wound around the chain. The purpose of the power cord will be evident from the ensuing discussion.

Each receptacle is preferably in the form of a drinking glass, but can be any other receptacle as will occur to those skilled in the art based on this diclosure. A receptacle 12 is best shown in FIG. 2, and includes a base 28 and a body 30 which tapers inwardly from the top, open end 32 thereof to the base 28.

As mentioned above, the device 10 is adapted to present an illusion that fluid is continuously flowing into each of the receptacles 12, and thus includes a means for continuously delivering fluid into each receptacle and for continuously removing such fluid from each receptacle.

Figure 2:
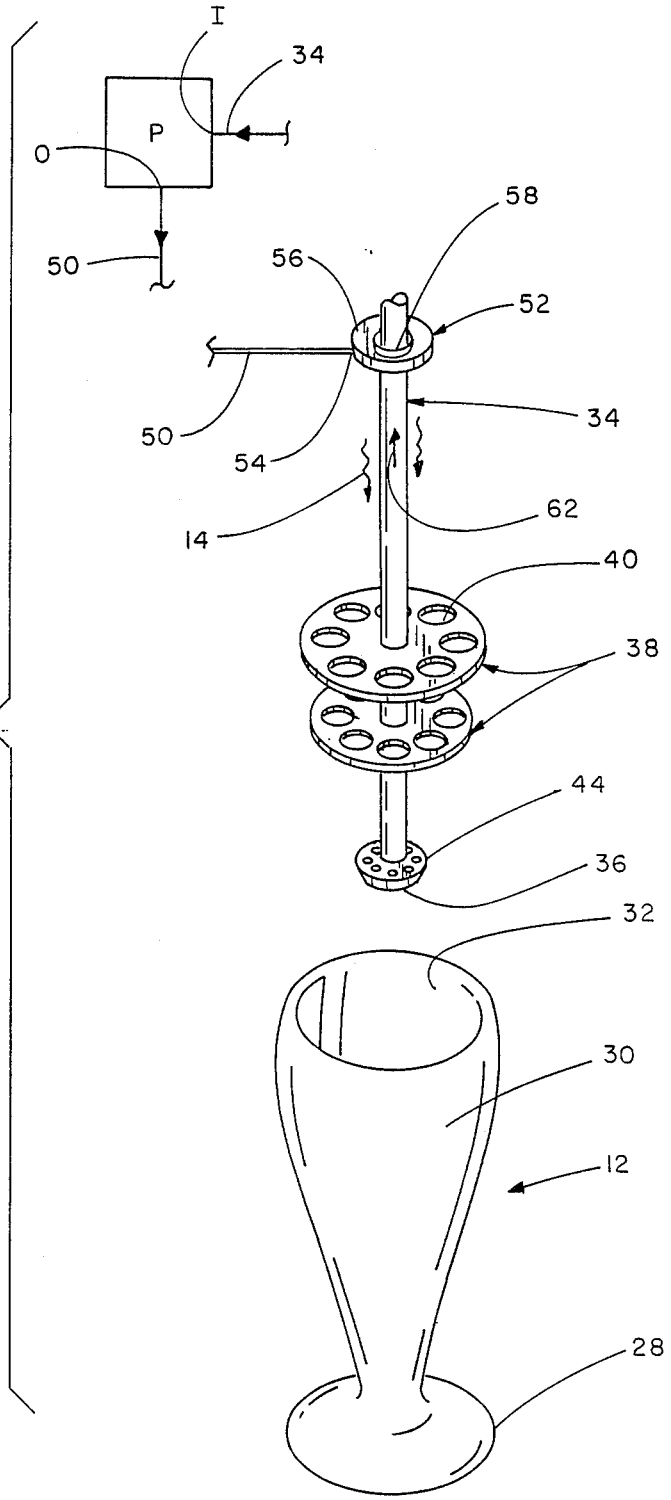
FIG. 2 is a perspective view of a receptacle used in the device.
Figure 3:
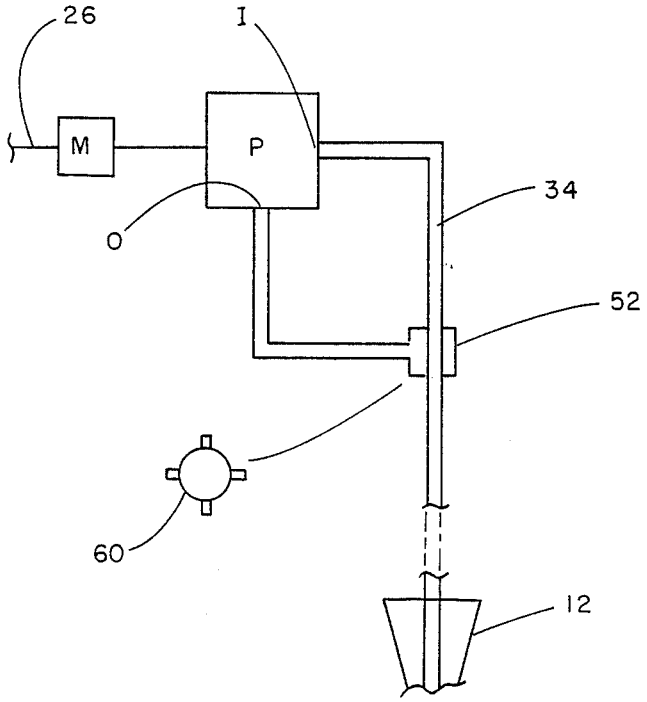
FIG. 3 is a fluid schematic of a flow circuit for one receptacle.

Such fluid delivery and return means is shown in FIGS. 2 and 3, and includes a return fluid line 34 having an inlet end 36 adapted to be located in the receptacle adjacent to the bottom of that receptacle and having an outlet end fluidically connected to an inlet I of a pump P as will be discussed below. The pump P is operated by a motor M connected to a source of power (not shown) by the power cord 26. It is also noted that the pump and motor can be located inside the top 20 if desired.

The means further includes supports 38 sized and located to securely engage the inner surface of the receptacle to support the return fluid line 34 in position in the receptacle. The supports 38 include holes, such as hole 40 for permitting desired fluid flow conditions to be established in the receptacle. If desired, such desired conditions could include foaming of the fluid, in which case the holes 40 will be arranged with respect to each other to establish such foaming action. The supports include a base support 44 having holes, such as hole 46, therein and which is sized to be mounted adjacent to the inlet 36 of line 34 and to support that inlet near the bottom of the receptacle. The supports 38 and 44 can be attached to the inner surface of the receptacle to support such receptacle. In such case, since the return line 34 is hidden by the fluid during operation of the device 10, it will appear to an observer that the receptacle is unsupported and "floating" in air if the base 18 is removed, or if the base 18 is spaced from the bottom of the receptacles. This "floating" receptacle will add to the visual effects achievable by the device 10.

Further visual effects can be created by including a light source L in the top 20 or a light source L' in the base or a combination of such sources or a plurality of such sources in both the top and the base. The light source can include one or more lights of one or more colors in either the top or in the base as indicated in FIG. 1, and the mult-light source can include means for turning the various lights on and off in synchronism with the movement of the fluid in the device. The colors of the lights can be changed to match different colors of fluids as will be evident from the ensuing discussion.

Fluid is delivered to the receptacle along the outside of the line 34 as indicated by arrows 14' in FIG. 2. This fluid is delivered from pump P via an outlet O to delivery line 50. The delivery line thus has its inlet end fluidically connected to the pump outlet O, and has an outlet end fluidically connected to a weir 52 via a feed fluid opening 54 to deliver such fluid from the pump to the fluid manifold means or weir. The weir includes an annular base 56 and a wall connected to the base around the outer perimeter thereof. The annular base includes a drain 58 located centrally thereof to surround the outside of the return line 34, and is mounted on the outside of the return line at the drain by a spider element 60 shown in FIG. 3. The spider element includes a web-like structure to accomplish a supporting function while still permitting fluid to flow past that spider down the outside of the line 34.

As can be understood from the foregoing, fluid is continuously delivered from pump P via line 50 to weir 52, and from the weir drain 58 to the outside of the line 34 to flow into the receptacle 12. That fluid is returned to the pump P via line 34 as indicated by arrow 62 in FIG. 2 to be re-circulated back to the receptacle.

Figure 4:
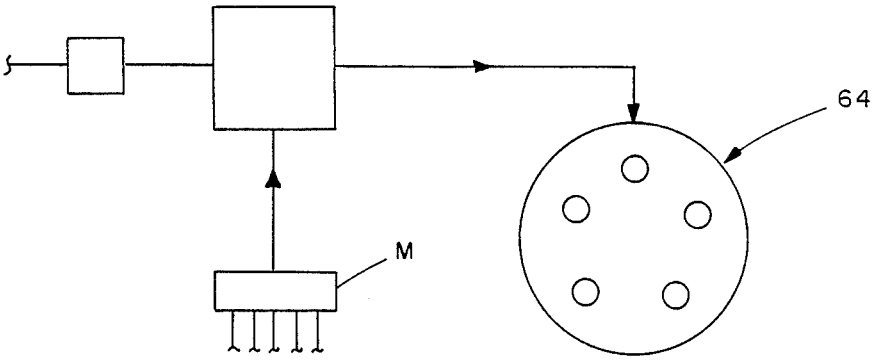
FIG. 4 is a fluid schematic of a flow circuit wherein a plurality of receptacles are fluidically connected to a single pump via a single weir.

As discussed above, the device 10 is adaptable to produce a plurality of different visual effects, and to this end, the device 10 includes a plurality of receptacles 12. Each receptacle can include a system as just discussed connected individually to the pump, or a single weir 64 (best shown in FIG. 4) can be used in conjunction with all of the receptacles. The single weir 64 therefore includes a plurality of drains 58' each associated with one of the lines 34. Fluid is directed into the weir from line 50 via inlet 54 as before discussed.

Fuild from each of the receptacles is returned to the pump P via lines 34 each fluidically connected to a manifold M which is fluidically connected to the pump inlet O by a line 50'. The manifold can combine all of the fluid or can include a plurality of separate passages as desired. A controller can also be included to control the manifold if such manifold includes a plurality of valves or the like. In such a manner, the flow conditions in each receptacle can be adjusted so that even flow is establised in each receptacle without overflowing. This may be necessary if the flow from the weir is not even out of all drains.

Figure 5:
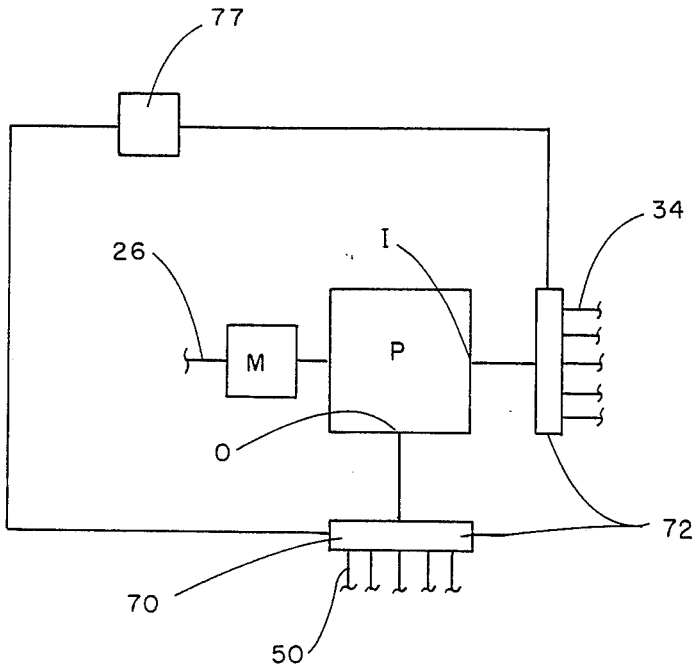
FIG. 5 is a fluid schematic of a flow circuit wherein a controller is connected to a multi-position inlet valve and to a multi-position outlet valve so that a single pump can control a plurality of receptacles according to a pre-selected sequence of operation.

If a sequence of operation is desired, such as filling one receptacle while emptying another, or such as filling one receptacle with one color of fluid while filling another with another color fluid, or combining such operations in time to music and/or light combinations to establish a "dancing waters" effect, the device 10 will include a multi-position feed line valve means 70 and a multi-position return line valve means 72 as shown in FIG. 5. These valve means fluidically connect the return lines 34 to the pump inlet I and fluidically connect the feed lines 50' to the various weirs as necessary, and are controlled by a controller 77, such as a computer, or the like. The controller 77 can include a music device and can have the computer programmed to open and close the valves in a pre-arranged sequence. Of course the valve 70 will be coordinated with the valve 72 so that the fluid will follow the proper path through the fluid circuit.

Figure 6:
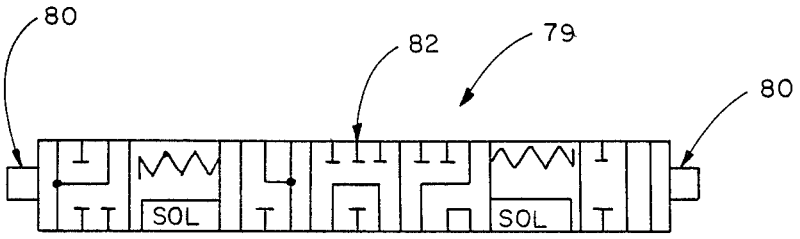
FIG. 6 is a schematic of a multi-port, multi-position valve which can be used to control the sequence of operation of the device.

One skilled in the art will be able to determine how to associate the valves and the elements of such valves to accomplish this objective based on the general knowledge of valves and controls. However, one mulit-port, multi-position valve suitable for use as either valve means 70 or valve means 72 is shown in FIG. 6 as valve means 79. The valve means 79 is a five-position, six-port (six-way) spring-centered valve with solenoid controls. The valve means 79 could include additional solenoid controls at 80 or such additional controls could include spring means. The neutral position of valve means 79 is shown at 82, and any given position is obtained by energizing the control adjacent to the position. Both of the valve means 70 and 72 could include a valve such as valve 79, and in such manner, establish a great variety of visual effects.

Figure 7:
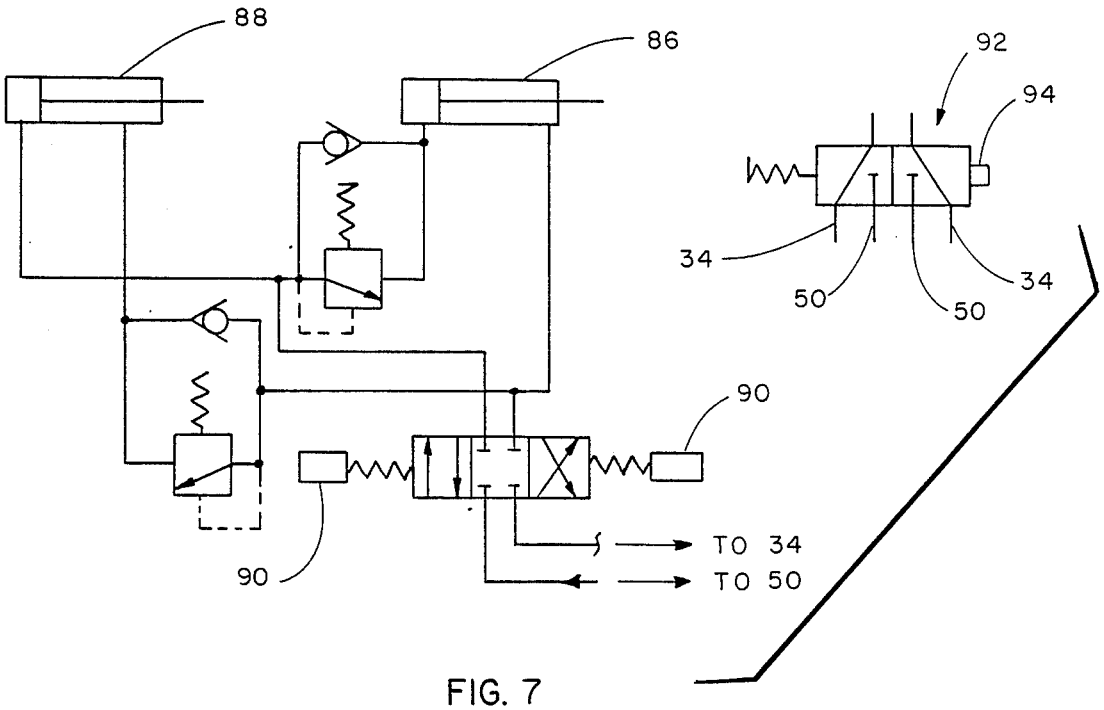
FIG. 7 is a schematic of a fluid circuit for use in a sequenced operation of the device and in which two cylinders move in sequence.

Another means of establishing sequenced operation of the device 10 is indicated in FIG. 7 in which two cylinders 86 and 88 are operated in sequential order. The cylinders act like the afore-discussed pump, and pressure sequence valves are used to control the movements of these two cylinders. Controls 90 can be either manual or electrical. Valves, such as two port valve 92 can be used in conjunction with the FIG. 7 system to control operation and direction of fluid flow to and from the receptacles in a timed manner with respect to the remainder of the system. The valve 92 can be controlled by controller 77 via control element 94. Other valve elements will occur to one skilled in the art based onthe general knowledge of fluid valves and fluid circuits and the disclosure presented hereinabove.

It is to be understood that while ceratin forms of the present invention have been illustrated and described herein, it is not to be limited to the specific forms or arrangement of parts described and shown.

I claim:

1. A display device for producing an illusion of a continuously flowing fluid comprising:

a decorative receptacle;

a fluid pump having an inlet and an outlet;

a return fluid line having an inlet located in said decorative receptacle and an outlet connected to said fluid pump inlet and fluidically connecting said receptacle to said fluid pump inlet;

a base support fixedly attached to said return fluid line adjacent to said return fluid line inlet, said base support being fixedly mounted to said decorative receptacle to suspend said decorative receptacle from said return fluid line and having a plurality of fluid passages defined therethrough through which fluid from said decorative receptacle passes as such fluid flows toward said return fluid line inlet;

two supports fixed to said return fluid line at positions that are spaced apart from each other and from said base support, said two supports being fixed to said decorative receptacle to connect said decorative receptacle to said return fluid line via said two supports, each of said two supports including a plurality of fluid passages defined therethrough;

a fluid manifold means on said return fluid line, said fluid manifold means including a base and a cylindrical wall extending from said base, said base having a fluid passage defined there-through centrally thereof.

a spider support mounted on said base adjacent to said base fluid passage and connected to said fluid return line and connecting said base to said return fluid line adjacent to said base fluid passage so that said base and said cylindrical wall surround said return fluid line, and a feed fluid opening defined through said cylindrical wall;

a feed fluid line fluidically connected to said cylindrical wall feed fluid opening and to said pump outlet to direct fluid from said pump outlet to said fluid manifold means; and fluid directed to said fluid manifold means from said pump flowing along the outside of said return fluid line from said base centrally located fluid passage, and from said decorative receptacle back to said pump via said return fluid line.

2. The device defined in claim 1 including a plurality of decorative receptacles, each fluidically connected to said fluid pump.

3. A display device for producing an illusion of a continuously flowing fluid comprising:

a plurality of decorative receptacles;

a fluid pump having an inlet, an outlet, a feed conduit fluidically connected to said inlet, and a return conduit fluidically connectred to said inlet;

a plurality of return fluid lines, each return fluid line of said plurality of return fluid lines having an inlet located in one decorative receptacle of said plurality of decorative receptacles and an outlet fluidically connected to said fluid pump inlet and fluidically connecting said one decorative receptacle to said fluid pump inlet;

a base support fixedly attached to said each return fluid line adjacent to said each return fluid line inlet, said base support being fixedly mounted to the decorative receptacle associated with said each return fluid line to suspend said associated decorative receptacle from said each return fluid line and having a plurality of fluid passage defined therethrough through which fluid from said associated decorative receptacle passes as such fluid flows toward said each return fluid line inlet;

two supports fixed to each return fluid line at positions that are spaced apart from each other and from the base support on said each fluid return line, said two supports being fixed to said associated decorative receptacle to connect said associated decorative receptacle to said each return fluid line via said two supports, each of said two supports including a plurality of fluid passages defined therethrough;

a plurality of feed lines fluidically connected to said fluid pump outlet, each feed line of said plurality of feed lines being fluidically connected to one decorative receptacle of said plurality of decorative receptacles;

a fluid flow control system for directed fluid from said pump to selected ones of said plurality of decorative receptacles and returning fluid from said selected ones of said pluralilty of decorative receptacles to said pump, including a return line vales means fluidically interposed between said fluid pump return conduit and each of said plurality of return lines, a feed line valve means fluidically interposed between said fluid pump feed conduit and each of said plurality of feed lines, and control means connected to said return line valve means and to said feed line valve means and controlling operation of said valve means.

4. The device defined in claim 3 wherein said return line valve means includes a five-position, six-port spring centered valve with solenoid control means.

5. The device defined in claim 4 wherein said feed line valve means includes a five-position, six-port spring centered valve, with solenoid control means.

6. The device defined in claim 3 wherein said control means includes means for filling said decorative receptacles according to a pre-selected sequence.

7. The devie defined in claim 6 further including colored fluid.

8. The device defined in claim 7 further including a plurality of colored fluids.

9. The device defined in claim 2 wherein each of said plurality of decorative receptacles is fluidically connected to said fluid manifold means.

10. The device defined in claim 9 wherein said weir includes a single feed line opening and a plurality of drains, each drain being associated with one of said plurality of decorative receptacles.

11. The device defined in claim 2 further including a plurality of weirs, with each fluid manifold means being associated with one of said plurality of decorative receptacles.

12. The device defined in claim 1 further including a support means mounting said receptacle on the return line with said return line being mounted on said support means.

13. The device defined in claim 8 further including a plurality of colored lights located to shine on said receptacles.

14. A display device for producing an illusion of a continuously flowing fluid comprising:

a plurality of decorative receptacles;

two fluid pumps, each fluid pump having
an inlet,
an outlet,
a feed conduit fluidically connected to said inlet, and
a return conduit fluidically connected to said inlet;

a plurality of return fluid lines, each return fluid line of said plurality of return fluid lines having an inlet located in one decorative receptacle of said plurality of decorative receptacles and an outlet fluidically connected to said one fluid pump of said fluid pump inlets and fluidically connecting said one decorative receptacle to said one fluid pump inlet;

a base support fixedly attached to said each return fluid line adjacent to said each return fluid line inlet, said base support being fixedly mounted to the decorative receptacle associated with said each return fluid line to suspend said associated decorative receptacle from said each return fluid line and having a plurality of fluid passages defined therethrough through which fluid from said associated decorative receptacle passes as such fluid flows toward said each return fluid line inlet;

two supports fixed to each return fluid line at positions that are spaced apart from each other and from the base support on said each fluid return line, said two supports being fixed to said associated decorative receptacle to connect said associated decorative receptacle to said each return fluid line via said two supports, each of said two supports including a plurality of fluid passages defined therethrough;

a plurality of feed lines fluidically each connected to one fluid pump outlet of said two fluid pumps, each feed line of said plurality of feed lines being fluidically connected to one decorative receptacle of said plurality of decorative receptacles;

sequencing means for said fluid pumps.

15. The device defined in claim 14 wherein said sequencing means includes a two-port valve.

* * * * *